US009690257B2

(12) United States Patent
Papi

(10) Patent No.: US 9,690,257 B2
(45) **Date of Patent: *Jun. 27, 2017**

(54) ANNUAL OR PERPETUAL CALENDAR MECHANISM AND TIMEPIECE COMPRISING THE SAME

(71) Applicant: Société anonyme de la Manufacture d'horlogerie Audemars Piguet & Cie, Le Brassus (CH)

(72) Inventor: Giulio Papi, La Chaux-de-Fonds (CH)

(73) Assignee: Société anonyme de la Manufacture d'horlogerie Audemars Piguet & Cie, Le Brassus (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/949,122

(22) Filed: Nov. 23, 2015

(65) Prior Publication Data

US 2016/0154381 A1 Jun. 2, 2016

(30) Foreign Application Priority Data

Nov. 27, 2014 (EP) ..... 14195261

(51) Int. Cl.
*G04B 19/24* (2006.01)
*G04B 19/253* (2006.01)

(52) U.S. Cl.
CPC ..... *G04B 19/241* (2013.01); *G04B 19/2536* (2013.01)

(58) Field of Classification Search
CPC ..... G04B 19/241; G04B 19/25346; G04B 19/2536; G04B 19/2538; G04B 19/2541
See application file for complete search history.

(56) References Cited

U.S. PATENT DOCUMENTS

| | | | | | |
|---|---|---|---|---|---|
| RE837 | E * | 10/1859 | Skinner | G04B 19/2536 | 368/37 |
| 30,166 | A * | 9/1860 | Strode | G04B 19/2536 | 368/37 |
| 368,961 | A * | 8/1887 | Morton | G04B 19/247 | 368/37 |
| 3,841,084 | A | 10/1974 | Eumier | | |
| 4,674,889 | A | 6/1987 | Klaus | | |
| 7,706,214 | B2 | 4/2010 | Scheufele | | |
| 2005/0056691 | A1 * | 3/2005 | Eisenegger | G04B 19/25366 | 235/10 |

(Continued)

FOREIGN PATENT DOCUMENTS

| | | | | |
|---|---|---|---|---|
| CH | 710563 | A2 * | 6/2016 | G04B 19/24 |
| DE | 23 11 539 | A1 | 11/1973 | |
| EP | 1 586 962 | A2 | 10/2005 | |

*Primary Examiner* — Amy Cohen Johnson
*Assistant Examiner* — Daniel Wicklund
(74) *Attorney, Agent, or Firm* — Drinker Biddle & Reath LLP

(57) ABSTRACT

In an annual or perpetual calendar mechanism, a lever bears a maneuvering device of a day-of-the-month wheel. A month wheel defines course beginning stops, each associated with a month and operational for controlling a course beginning position of the lever when the month wheel is in the angular position associated with this month. These course beginning stops are bottoms of slots alternating with the teeth of the month wheel. The month wheel has a peripheral edge which forms the profile of its teeth as well as the course beginning stops.

12 Claims, 5 Drawing Sheets

(56) References Cited

U.S. PATENT DOCUMENTS

| | | | | |
|---|---|---|---|---|
| 2005/0078558 | A1* | 4/2005 | Dalloz | G04B 19/241<br>368/37 |
| 2005/0232085 | A1 | 10/2005 | Scheufele | |
| 2006/0215497 | A1* | 9/2006 | Schneider | G04B 19/253<br>368/35 |
| 2013/0329531 | A1* | 12/2013 | Nguyen | G04B 19/202<br>368/37 |
| 2016/0187852 | A1* | 6/2016 | Goeller | G04B 19/24<br>368/28 |

* cited by examiner

FIG. 4
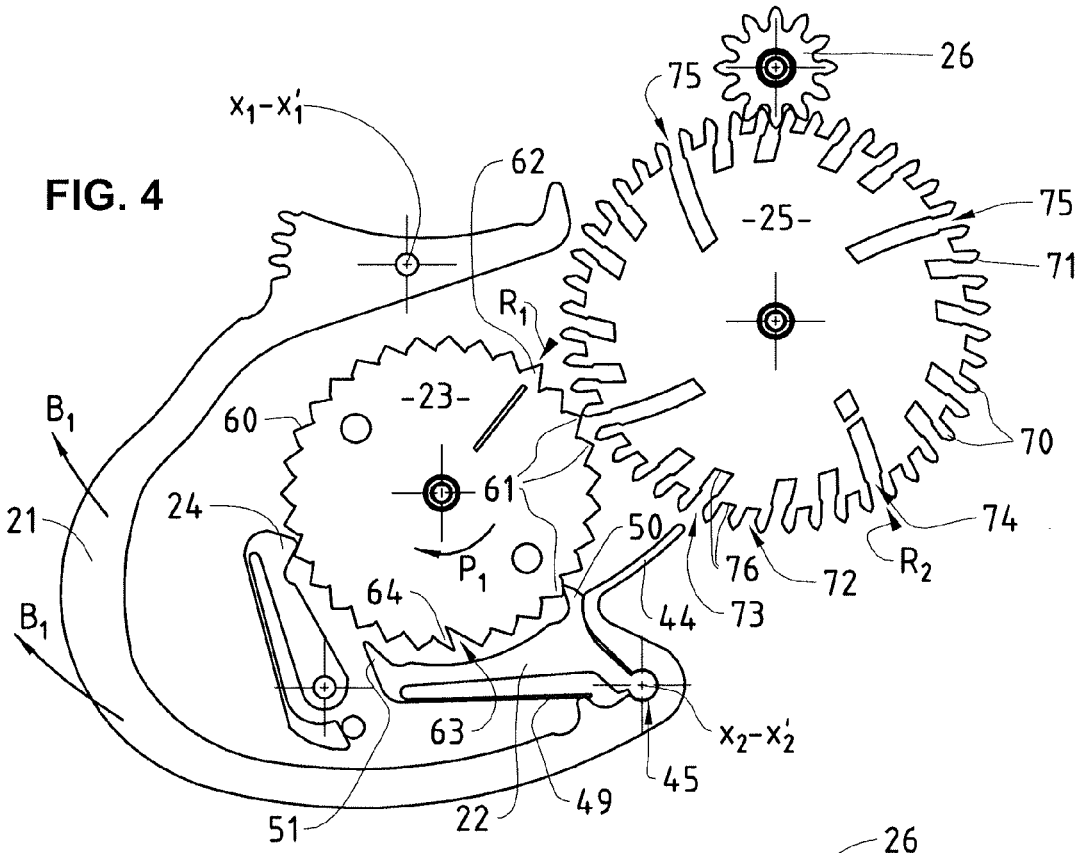
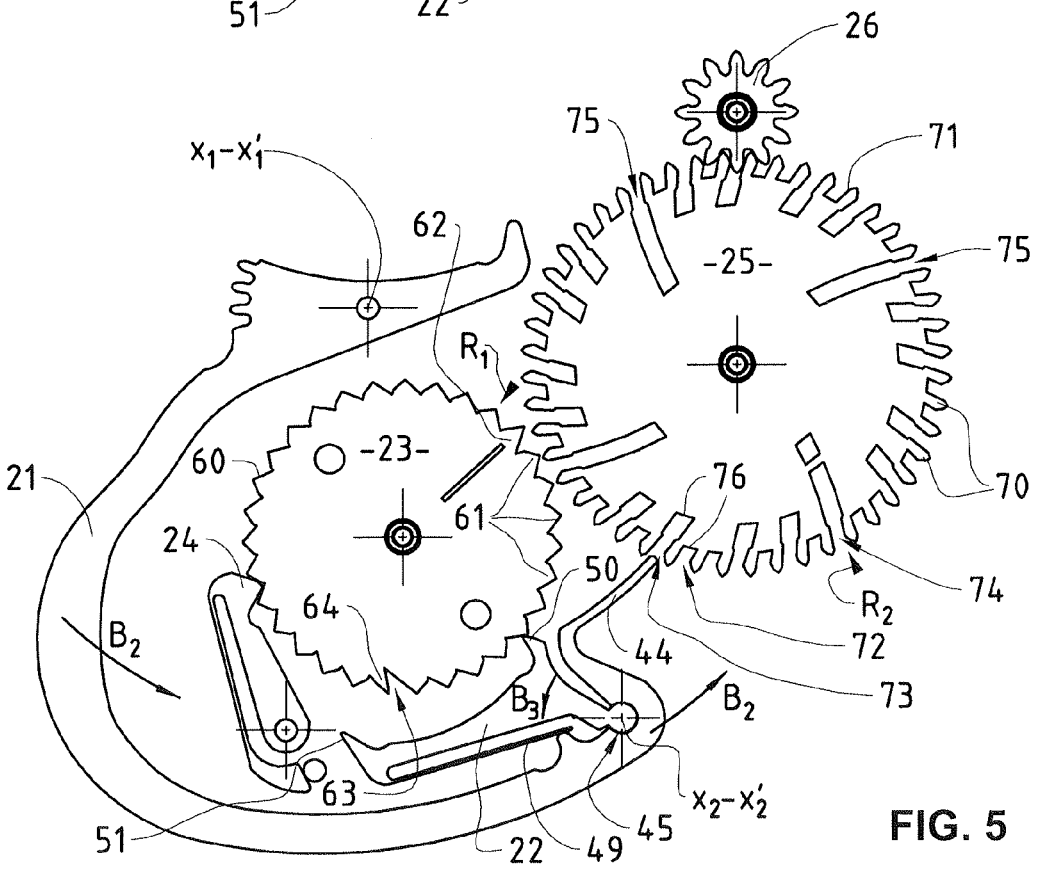
FIG. 5

FIG. 6
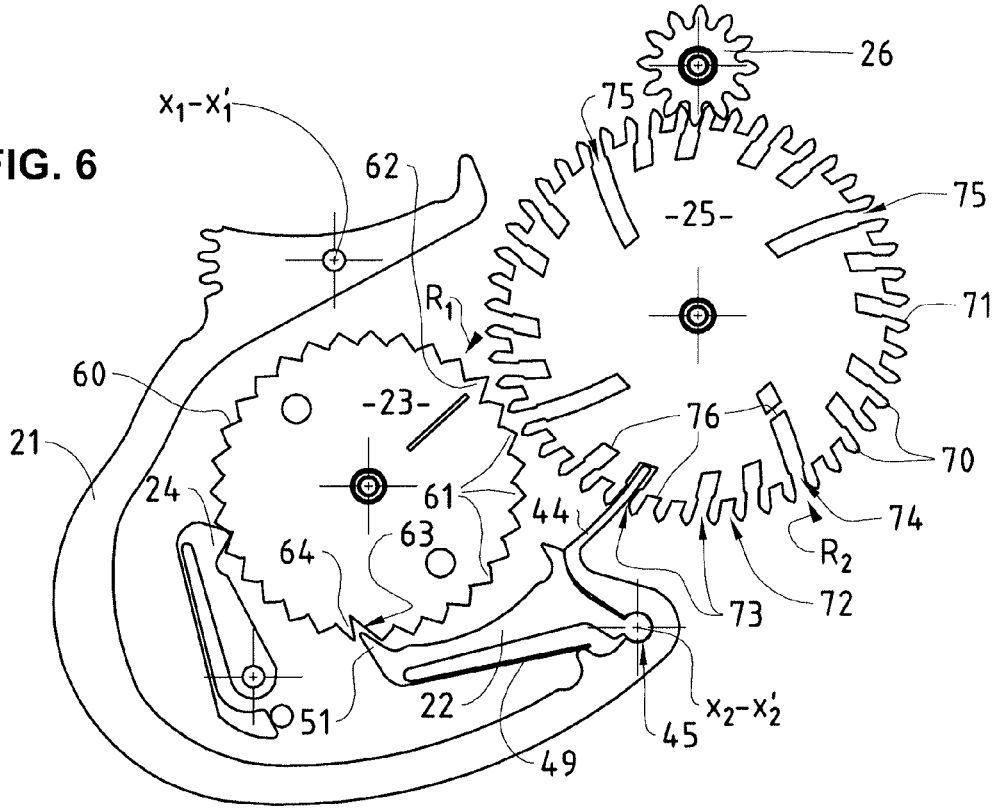
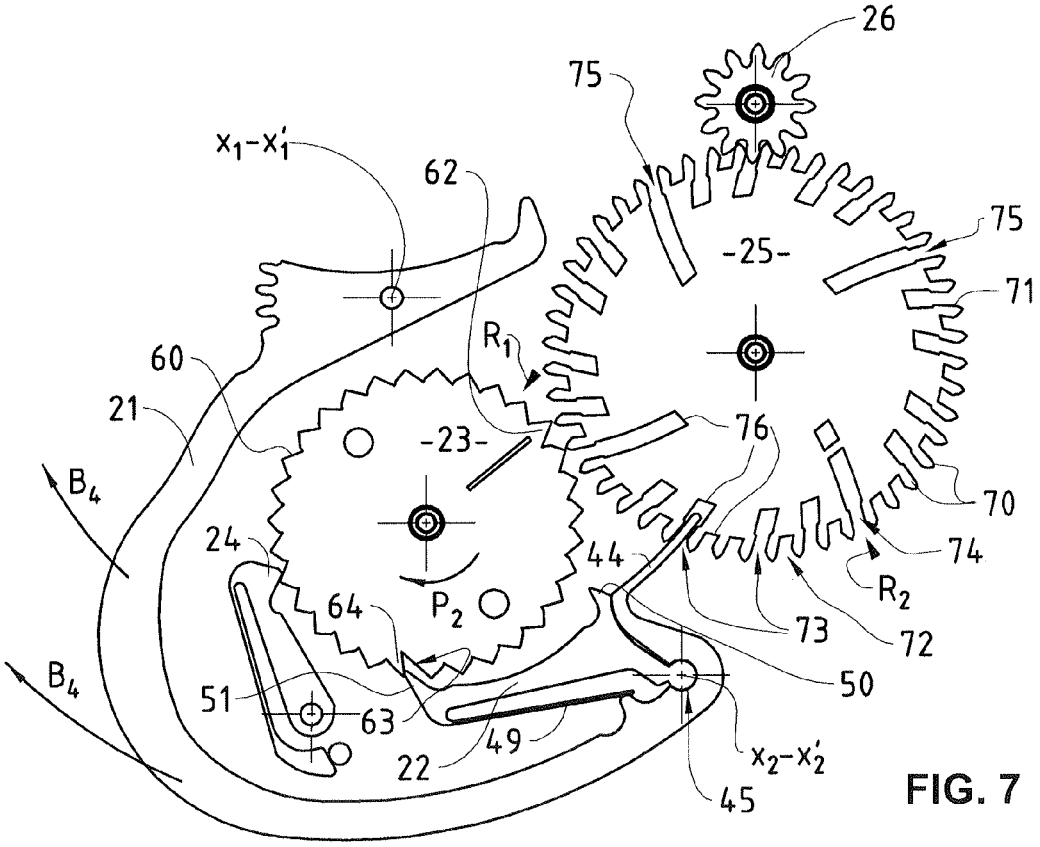
FIG. 7

FIG. 8
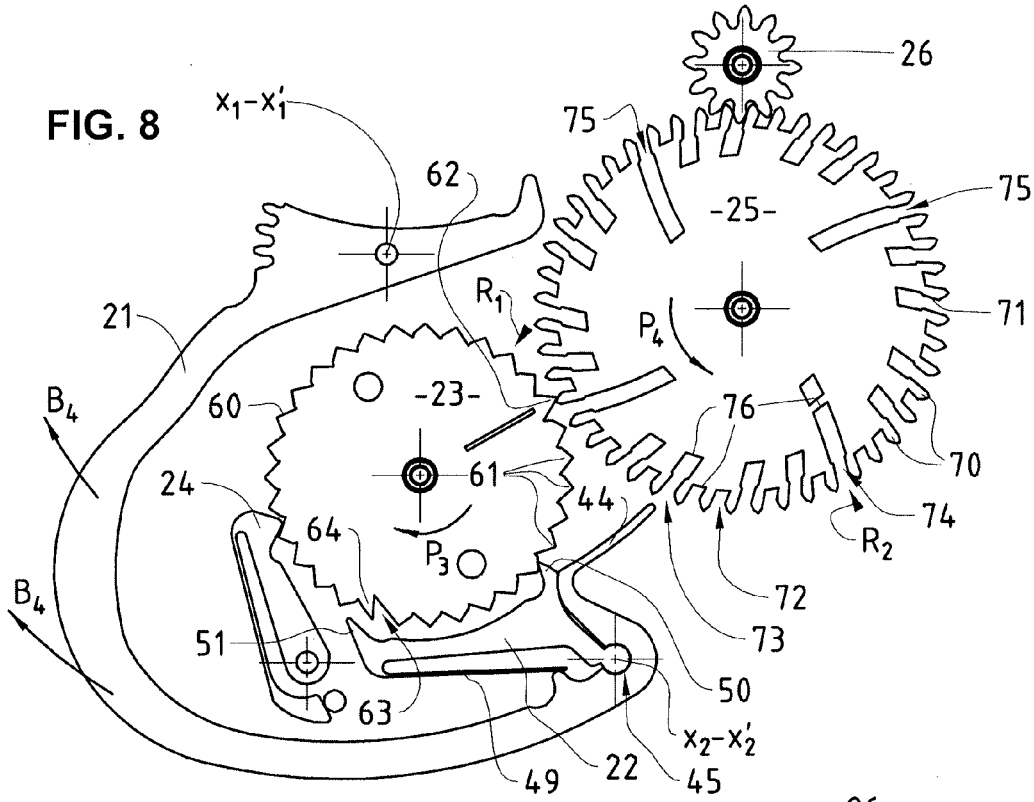
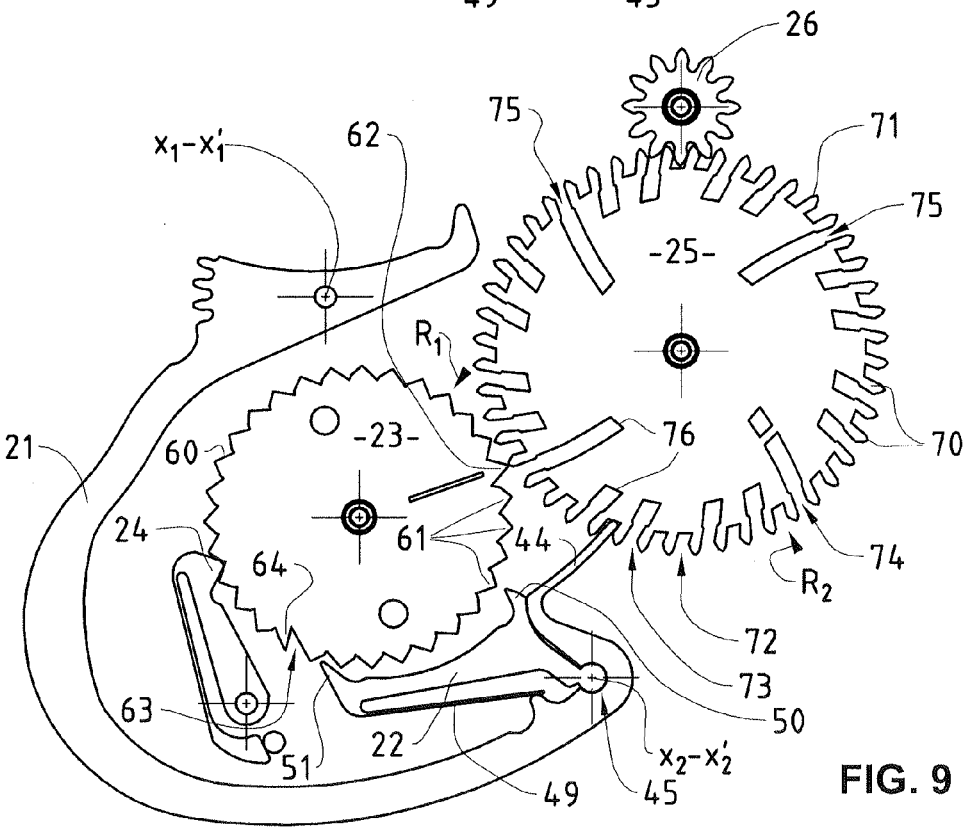
FIG. 9

ANNUAL OR PERPETUAL CALENDAR MECHANISM AND TIMEPIECE COMPRISING THE SAME

CROSS-REFERENCE TO RELATED APPLICATIONS

The present patent application claims priority under 35 U.S.C. §119 to European Patent Application No. 14195261.4 filed on Nov. 27, 2014, the entire contents of which are herewith incorporated by reference.

TECHNICAL FIELD OF THE INVENTION

This invention relates to the field of watchmaking. More specifically, it concerns an annual or perpetual calendar mechanism as well as a timepiece comprising such a mechanism.

STATE OF THE ART

A watch can be equipped with a display which presents one or more pieces of information concerning the current date and comprising the day of the month. This display is controlled by a mechanism such as an annual calendar mechanism or a perpetual calendar mechanism, which is driven by the movement of the watch.

An annual calendar mechanism takes into account the existence of months of fewer than 31 days in the Gregorian calendar and carries out, at the end of each of these months, a correction in which the excess day or days of the month are quickly passed until the first day of the following month. A perpetual calendar mechanism carries out the same corrections as an annual calendar mechanism, as well as a correction adding the day of the month 29 at the time of a month of February of a leap year.

Described in the U.S. Pat. No. 4,674,889 is a perpetual calendar mechanism, in which a day-of-the-month wheel comprises thirty-one teeth each provided to receive an actuation by one step from a first pawl during a passage from one day to the following day. This day-of-the-month wheel forms part of a mobile of days of the month likewise comprising a snail whose two ends are separated by a notch enabling a second pawl to carry out the corrections at the end of the months of fewer than 31 days. A same lever bears the first and the second pawl. Through the agency of its peripheral toothing, a month wheel is driven from the movement of the day-of-the-month mobile, at the rate of one step for each change of month. It is integral with a cam which regulates the amplitude of the movement of the lever and which thus determines, for each month, whether a correction must be carried out, and in the affirmative, how many days of the month this correction must be.

SUMMARY OF INVENTION

According to one aspect of the present invention, an annual or perpetual calendar mechanism is provided. This annual or perpetual calendar mechanism preferably includes a day-of-the-month mobile which is rotational between 31 successive angular positions each associated with one of 31 days of the month and which comprises a notch and a day-of-the-month wheel having 31 teeth. The annual or perpetual calendar mechanism preferably includes a month wheel which is rotational between successive angular positions each associated with one of the 12 months of the year, which has as many teeth as the month wheel has angular positions and which defines course beginning stops each associated with a month and operational for controlling a course beginning position when the month wheel is in the angular position associated with this month. Preferably, each of the teeth of the month wheel has a profile which a peripheral edge of this month wheel forms. Preferably, the peripheral edge of the month wheel also forms the course beginning stops which are bottoms of slots alternating with the teeth of the month wheel. The annual or perpetual calendar mechanism preferably includes an actuation finger for effecting, on one of the teeth of the month wheel, an actuation of one step making the month wheel pass from one month to the following month, at each passage of the day-of-the-month mobile from the last day of the month of one month to the first day of the month of the following month. The annual or perpetual calendar mechanism preferably includes a lever provided to be actuated once a day, starting from the course beginning position. The annual or perpetual calendar mechanism preferably includes a maneuvering device borne by the lever and comprising two pawl fingers, namely a first pawl finger for effecting, on one of the 31 teeth of the day-of-the-month wheel, an actuation of one step making the day-of-the-month mobile pass from one day of the month to the following day of the month among its 31 successive positions, at each actuation of the lever, and a second pawl finger for effecting, on the notch, an actuation of the day-of-the-month mobile by a whole number of steps determined by the course beginning position of the lever, at the time of an actuation of this lever at the end of a month of fewer than 31 days.

In this way, the month wheel can constitute the month mobile, whose thickness can thus be reduced to the thickness of one wheel.

One object of the features of the invention is make it possible to reduce locally or everywhere at least one dimension of the bulkiness of an annual or perpetual calendar mechanism.

The annual or perpetual calendar mechanism defined above can incorporate one or more other advantageous features, by themselves or in combination, in particular among those cited in the following.

Advantageously, each of the 31 teeth of the day-of-the-month wheel has a profile that a peripheral edge of this day-of-the-month wheel forms. The peripheral edge of the day-of-the-month wheel also forms the notch which is positioned between two consecutive teeth among the 31 teeth of the day-of-the-month wheel. When such is the case the day-of-the-month wheel can constitute the day-of-the-month mobile, whose thickness can thus be reduced to the thickness of one wheel.

Moreover, when this is so, it is advantageous to foresee in addition that the day-of-the-month wheel, the month wheel, the lever and the maneuvering device extend in a same plane and the annual or perpetual calendar mechanism assembly can be flattened and can have a thickness on the order of the thickness of one wheel only.

Preferably, the 31 teeth of the day-of-the-month wheel are made up of 30 teeth of a first type and one tooth of a second type. Each tooth of the first type has a crest and a rear face which extends progressively rearwards while going away from this crest so as to be able to be hooked by the first pawl finger and not by the second pawl finger. The tooth of the second type has a crest and a rear face delimiting the notch, which rear face extends progressively forwards while going away from this crest such that the tooth of the second type can be hooked just as well by the first pawl finger as by the second pawl finger.

Advantageously, a piece defining at least one of the first and second pawl fingers is pivotably mounted on the lever by means of a cylindrical articulation comprising a cylindrical accommodation and a complementary cylindrical head. Preferably the cylindrical accommodation is open radially at a radial passage, between two positions angularly offset, one with respect to the other, about a rocking axis of the cylindrical head in the cylindrical accommodation. Preferably, the cylindrical head is borne by a neck passing through the radial passage. A cylindrical articulation thus formed can be flat and can extend in one plane, notably in the same plane as the day-of-the-month wheel, which can make possible a reduction of the thickness of the annual or perpetual calendar mechanism.

Preferably, a same piece pivotably mounted on the lever and resiliently biased against a stop of this lever defines both me the first pawl finger and the second pawl finger, which second pawl finger is offset downstream with respect to the first pawl finger, considering the direction of pushing of a tooth of the day-of-the-month wheel by the first pawl finger. If this is the case, it can have the advantage of allowing a simplification through reduction of the number of parts and/or a benefit with respect to bulkiness.

Preferably, the lever comprises a feeler tail configured to be inserted in any slot among the slots and to be stopped by the bottom of this slot, in the course beginning position.

Preferably, each of the slots associated with months of fewer than 31 days comprises an entry situated between two consecutive teeth of the month wheel and a section which is located at a distance from these two consecutive teeth and which is widened with respect to the entry. When such is the case, the slots can be inserted between the teeth of the month wheel, without these teeth being too weakened and without risking that the insertion of the feeler tail in one of the slots associated with months of fewer than 31 days is achieved with difficulty.

Advantageously, the feeler tail has a curvature which is uniform and which is centered on a rocking axis of the lever. Preferably, at least the slots associated with months of fewer than 31 days each have, on their entire length, the same uniform curvature as the feeler tail.

Preferably, the annual or perpetual calendar mechanism comprises a pinion which meshes with the teeth of the month wheel and which is associated with a display of the current month. When such is the case, the teeth of the month wheel fulfil two functions, having in turn the function of receiving an actuation from the actuation finger and that of effecting an actuation of the pinion. A simplification results and a possibility of saving space.

Preferably the day-of-the-month wheel and the month wheel extend in a same plane. When such is the case, one of the teeth of the day-of-the-month wheel is, preferably, projecting radially further than the other teeth of this day-of-the-month wheel and forms the actuation finger.

It will be noted that an independent claim may also define the protected invention as being an annual or perpetual calendar mechanism comprising:

- a day-of-the-month mobile which is rotational between 31 successive angular positions each associated with one of 31 days of the month and which comprises a notch and a day-of-the-month wheel having 31 teeth,
- a lever provided to be actuated once a day,
- a maneuvering device borne by the lever and comprising two pawl fingers, namely
  - a first pawl finger for effecting, on one of the 31 teeth of the day-of-the-month wheel, an actuation of one step making the day-of-the-month mobile pass from one day of the month to the following day of the month among its 31 successive positions, at each actuation of the lever, and
  - a second pawl finger for effecting, on the notch, an actuation of the day-of-the-month mobile by a whole number of steps determined by the course beginning position of the lever, at the time of an actuation of this lever at the end of a month of fewer than 31 days, and wherein a same piece pivotably mounted on the lever and resiliently biased against a stop of this lever defines both the first pawl finger and the second pawl finger, which second pawl finger is offset downstream with respect to the first pawl finger, considering the direction of pushing of a tooth of the day-of-the-month wheel by the first pawl finger.

It will be noted that, in an independent claim, the protected invention may moreover be defined as being an annual or perpetual calendar mechanism comprising:

- a day-of-the-month mobile which is rotational between 31 successive angular positions each associated with one of 31 days of the month and which comprises a notch and a day-of-the-month wheel having 31 teeth,
- a lever provided to be actuated once a day,
- a maneuvering device borne by the lever and comprising two pawl fingers, namely
  - a first pawl finger for effecting, on one of the 31 teeth of the day-of-the-month wheel, an actuation of one step making the day-of-the-month mobile pass from one day of the month to the following day of the month among its 31 successive positions, at each actuation of the lever, and
  - a second pawl finger for effecting, on the notch, an actuation of the day-of-the-month mobile by a whole number of steps determined by the course beginning position of the lever, at the time of an actuation of this lever at the end of a month of fewer than 31 days, and wherein a piece defining at least one of the first and second pawl fingers is pivotably mounted on the lever by means of a cylindrical articulation comprising a cylindrical accommodation and a complementary cylindrical head. The cylindrical accommodation is open radially at a radial passage, between two positions angularly offset, one with respect to the other, about a rocking axis of the cylindrical head in the cylindrical accommodation. The cylindrical head is borne by a neck passing through the radial passage.

An embodiment of the invention has in addition as subject matter a timepiece which has one of the annual or perpetual calendar mechanisms defined in the foregoing.

BRIEF DESCRIPTION OF THE DRAWINGS

Other advantages and features will emerge more clearly from the description, which will follow, of a specific embodiment of the invention, given by way of non-limiting example and represented in the attached drawings, in which:

FIGS. 4 and 5 are views from above similar to FIG. 3 and illustrate a change of day of the month without change of month, each by showing the perpetual calendar mechanism of FIG. 2 in one of two intermediate configurations through which this mechanism passes successively during its evolution from the stable state of FIG. 3 to the following stable state;

FIG. 6 is a view from above which is similar to FIG. 3 and in which the calendar mechanism of FIG. 2 is in the stable state following that of FIG. 3 and corresponding to the date of 30 September of a leap year;

FIGS. 7 and 8 are views from above similar to FIG. 3 and illustrate a change of day of the month with change of month, by each showing the perpetual calendar mechanism of FIG. 2 in one of two intermediate configurations through which this mechanism passes successively during its evolution from the stable state of FIG. 6 to the following stable state; and FIG. 9 is a view from above which is similar to FIG. 3 and in which the calendar mechanism of FIG. 2 is in the stable state following that of FIG. 6 and corresponding to the date of 1 October of a leap year.

DETAILED DESCRIPTION OF THE PREFERRED EMBODIMENTS

Figure 1:
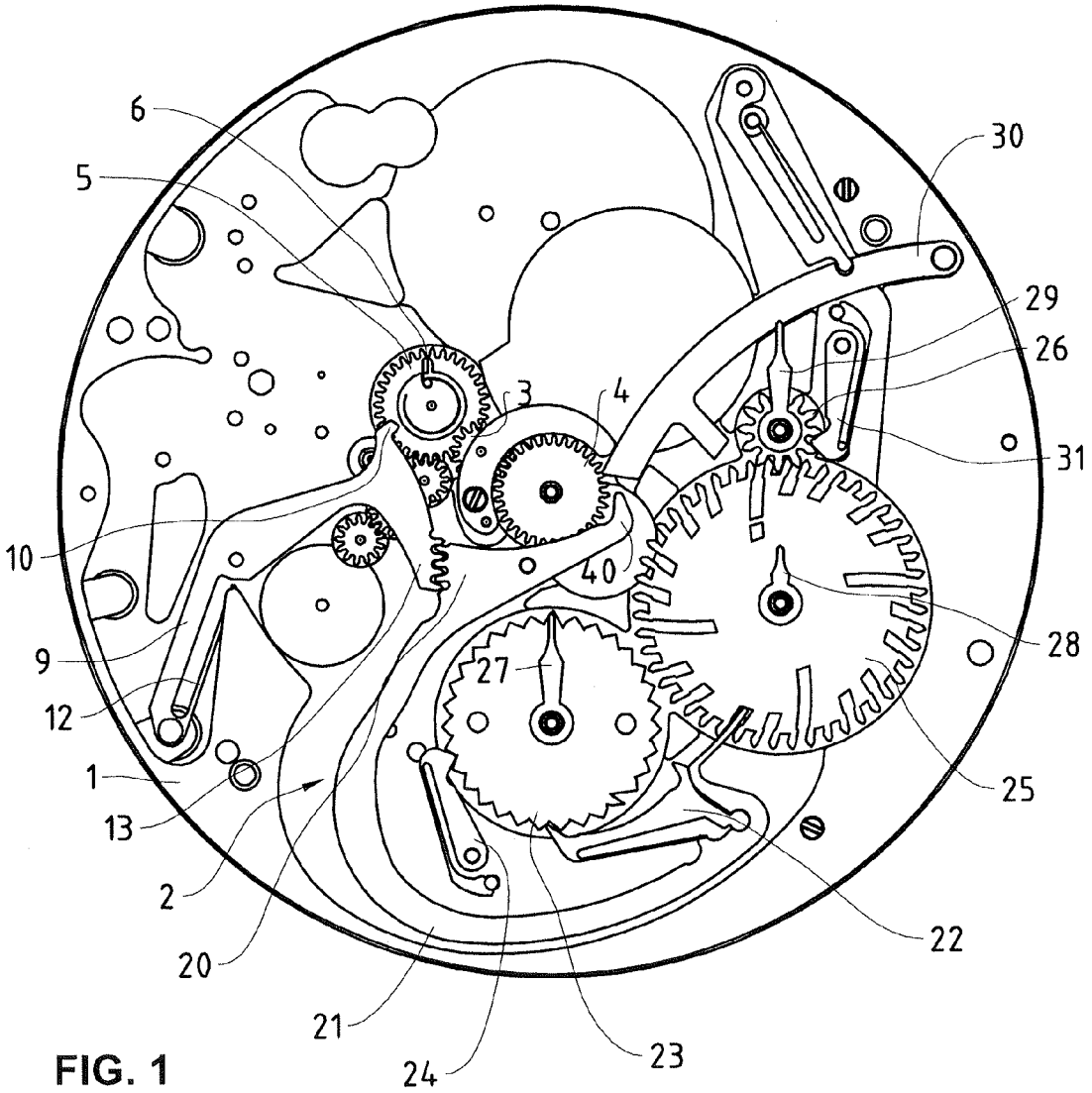
FIG. 1 is a view from above, dial side, on which a perpetual calendar mechanism according to the invention is attached to a clockwork movement of a wristwatch also according to the invention.

In FIG. 1, a wristwatch according to an embodiment of the invention is represented without its wristwatch case, without its dial and without other constituent parts, known per se and not having direct connection to the invention. The reference numeral 1 designates a clockwork movement to which is attached a perpetual calendar mechanism 2 according to an embodiment of the invention. A gear-train 3 couples the hours mobile 4 of the clockwork movement 1 to a toothed wheel 5, which is integral with a finger 6.

Like the toothed wheel 5, the finger 6 carries out one revolution per day. It is designed to maneuver an actuation lever 9 once a day by acting upon a catch 10 of this actuation lever 9.

A spring 12 is provided to return the actuation lever 9 to a waiting position after each maneuver of the latter. Besides the spring 12, the actuation lever 9 comprises a rack 13 which is engaged with a complementary rack 20 equipping a lever 21.

Bearing a double pawl 22 pivotably mounted, the lever 21 is a constituent part of the perpetual calendar mechanism 2, which also comprises a day-of-the-month mobile 23, a jumper 24 defining the stable angular positions of this day-of-the-month mobile 23, a month mobile 25, a pinion 26 of twelve teeth meshing with this month mobile 25, as well as a jumper 31 defining the stable angular positions of the pinion 26. A hand 27, integral with the day-of-the-month mobile 23, is provided to indicate the current day of the month on a circular graduation (known per se and not represented), which the dial (also not represented) of the watch bears. A hand 28, integral with the month mobile 25, is provided to indicate the current type of year, namely leap year or non-leap year, by designating one of four sectors, each of 90°, within a crown (known per se and not represented) which the dial of the watch bears. A hand 29, integral with the pinion 26, is provided to indicate the current month on a circular graduation (known per se and not represented) which the dial of the watch bears.

In a variant, all or some of the pieces of information which are the current day of the month, the current month and the current type of year can each be indicated by means of a movable disk concealed by the dial except at an aperture. For example, a disk bearing the numbers of the days of the month can be integral with the day-of-the-month mobile 23 and partially visible at the place of an aperture pierced in the dial of the watch. According to another possibility, given by way of example, the day-of-the-month mobile 23 can also be connected kinematically to a display device in the manner disclosed in the European Patent Application EP 1 586 962.

Provided for occasionally transmitting a manual command, a push button or push-piece 30 is able to act on one end 40 of the lever 21, as well as on the month mobile 25, in order to change the respective positions of this month mobile 25 and of the day-of-the-month mobile 23, during an updating of the date indicated by the hands 27, 28 and 29.

Figure 2:
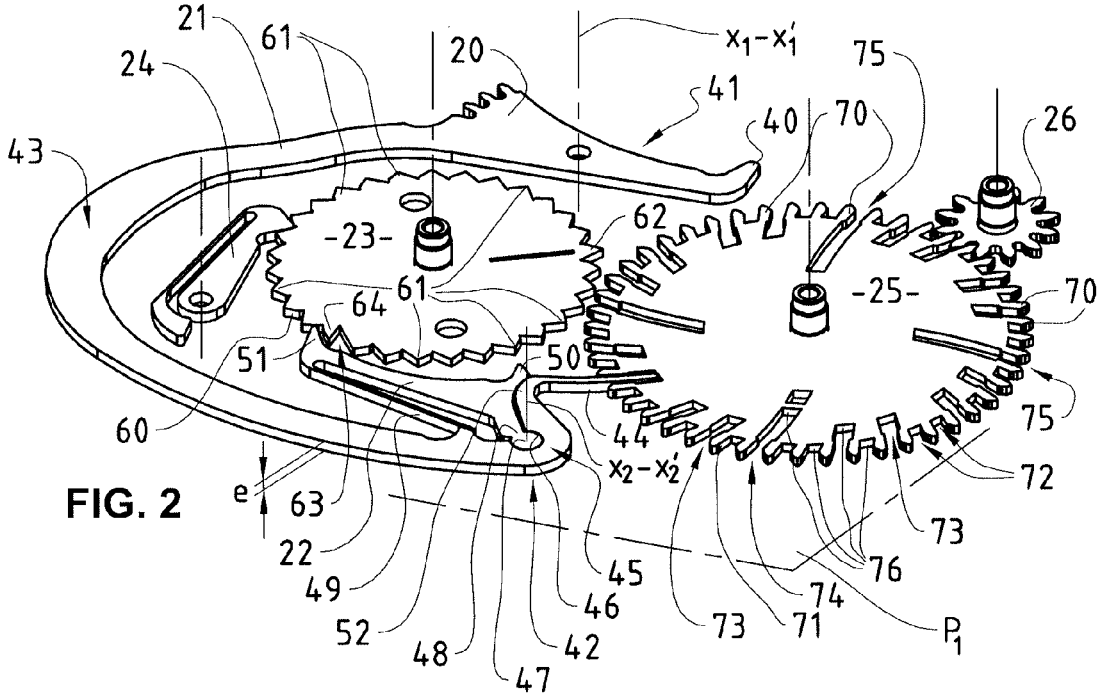
FIG. 2 is a view in perspective of the perpetual calendar mechanism visible in FIG. 1.

As can be seen in FIG. 2, the day-of-the-month mobile 23 is constituted solely by a day-of-the-month wheel. In the following, this day-of-the-month mobile and its day-of-the-month wheel are designated by the same reference numeral 23. With respect to thickness, the day-of-the-month mobile 23 has only one level, that is to say one fewer than the day-of-the-month mobile described in the aforementioned U.S. Pat. No. 4,674,889.

In a similar way, the month mobile 25 is constituted solely by a month wheel. In the following this month mobile and its month wheel are designated by the same reference numeral 25. With respect to thickness, the month mobile 25 has only one level, that is to say one fewer than the month mobile described in the aforementioned U.S. Pat. No. 4,674,889.

The perpetual calendar mechanism described in the aforementioned U.S. Pat. No. 4,674,889 comprises numerous components and it has a certain bulk. This bulk is likely to play a role in the thickness and the bulkiness of a watch incorporating the perpetual calendar mechanism. Now it can be desired, for aesthetic reasons and/or for reasons of wearing comfort, that the thickness and/or volume of a watch are not too great.

Excluding the mounting arbors for rotation and rocking, the perpetual calendar mechanism 2 is flat. Its lever 21, its double pawl 22, its day-of-the-month mobile 23, its jumper 24, its month mobile 25 and its pinion 26 are all flat and extend in a same plane $P_1$. Moreover they all have substantially the same thickness e, which is also that of the perpetual calendar mechanism 2, if the mounting arbors for rotation and rocking are excluded. Thus, the day-of-the-month mobile 23 has a thickness which is merely that of its day-of-the-month wheel 23, whereas the month mobile 25 has a thickness which is just that of its month wheel 25. The perpetual calendar mechanism 2 is thus particularly thin insofar as its thickness e is reduced to the thickness of one wheel.

Figure 3:
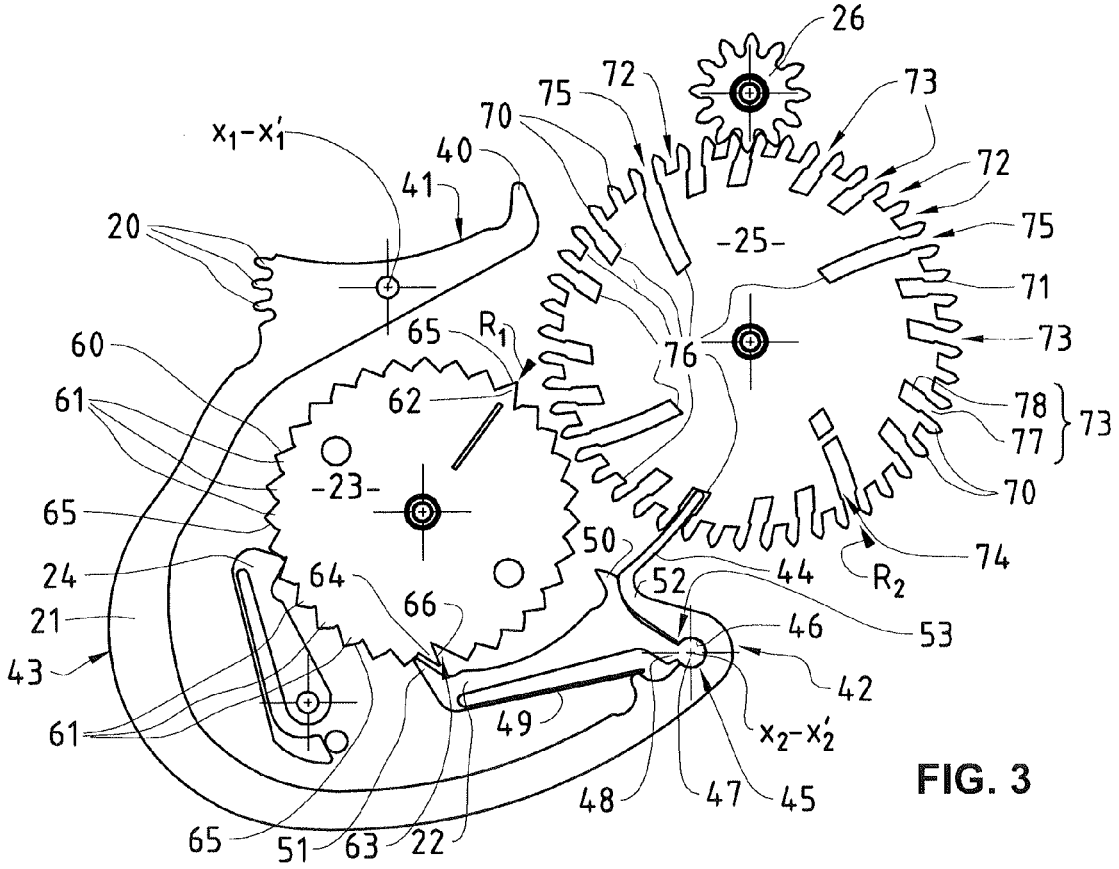
FIG. 3 is a view from above which represents the same perpetual calendar mechanism as FIG. 2 and in which this perpetual calendar mechanism is found in a stable state corresponding to the date of 29 September of a leap year.

As can be well appreciated from FIG. 3, the lever 21 comprises two opposite end portions 41 and 42, which are substantially facing on both sides of the day-of-the-month wheel 23 and which an arcuate curved arm 43, encircling this day-of-the-month wheel 23 over more than a half turn, connects. The rocking axis $X_1$-$X'_1$ of the lever 21 passes, at the end portion 41, between the end 40 and the rack 20 which this end portion 41 defines. The other end portion 42 ends with a feeler tail 44 provided to abut against the month wheel 25. It bears moreover the double pawl 22, which is pivotably mounted about a rocking axis $X_2$-$X'_2$ movable parallel to the rocking axis $X_1$-$X'_1$.

More precisely, the double pawl 22 is connected to the lever 21 by a cylindrical articulation 45, which is flat and which comprises a flat cylindrical accommodation 46 and a complementary flat cylindrical head 47. This cylindrical head 47 pivots in the cylindrical accommodation 46, on its pivot axis which is the rocking axis $X_2$-$X'_2$. The cylindrical accommodation 46 is delimited by a bend of the end portion 42, in such a way as to be open radially in the direction of the arcuate arm 43, at a radial passage 53. A neck 48 of the double pawl 22 enters radially through this radial passage 53, up to the cylindrical accommodation 46, and is prolonged by the flat head 47.

The double pawl 22 is a single piece defining the flat head 47, the neck 48, a return spring 49, as well as two consecutive pawl fingers, namely an upstream pawl finger 50 and a downstream pawl finger 51 which are both intended to make the day-of-the-month wheel 23 turn, but at distinct moments, as will be explained in more detail further on. In the following and in the attached claims, the terms "upstream" and "downstream", as well as analogous terms, refer to the direction of progression of a tooth hooked and driven by the double pawl 22. The spring 49 returns the double pawl 22 to an operational position, against a bend 52 which the feeler tail 44 prolongs. This feeler tail 44 has a uniform curvature, which is centered on the rocking axis $X_1$-$X'_1$ of the lever 21.

The day-of-the-month wheel 23 has thirty-one successive angular positions stabilized by the jumper 24. A day of the month is associated with each of these stabilized angular positions. When the day-of-the-month wheel 23 is pivoted by one step, it passes from one stabilized angular position to the following stabilized angular position, which corresponds to a passage of one day of the month to the following day of the month. The day of the month associated with a stabilized position of the day-of-the-month wheel 23 is indicated by the hand 27 when the day-of-the-month wheel 23 is in this stabilized position.

The day-of-the-month wheel 23 is a toothed wheel comprising a peripheral edge 60, as well as thirty-one peripheral radial teeth 61, 62 and 64, whose respective profiles are formed by this peripheral edge 60. Among the thirty-one peripheral teeth of the day-of-the-month wheel 23, thirty teeth 61 and 62 of a first type each have a substantially triangular profile. The peripheral edge 60 forms in addition a notch 63, which is found between a tooth 61 and a tooth of a second type 64. Each tooth 61 or 62 has a rear face 65 going away from the crest of this tooth 61 or 62 by extending progressively rearwards. The tooth 64 has a rear face 66 forming an edge of the notch 63 and moving away from the crest of this tooth 64 by extending progressively forwards. The upstream pawl finger 50 can hook and drive each of the teeth 61, 62 and 64 by one step in downstream direction. The downstream pawl finger 51 slides on the rear faces 65 of the teeth 61 and 62, which it can thus not drive. In contrast, the downstream pawl finger 51 can engage itself in the notch 63, can hook itself to the rear face 66 and drive the tooth 64 by one or more steps.

Among the teeth 61, 62 and 64 of the day-of-the-month wheel 23, a single one forms an actuation finger able to drive the month wheel 25 by one step. It is the tooth of the first type referred to by 62, which projects radially further than the other teeth of the first type 61 and than the tooth of the second type 64. The day-of-the-month wheel 23 carries out one turn per month. Its protruding tooth 62 thus carries out one complete revolution per month and, at each passage from one month to the following month, actuates the month wheel 25 by one step.

The month wheel 25 is a toothed wheel comprising forty-eight peripheral radial teeth 70. The peripheral edge 71 of this month wheel 25 forms the contour of each peripheral tooth 70. It delimits moreover forty-eight slots 72, 73, 74 and 75, that is to say as many slots as teeth 70.

Each of the slots 72 to 75 extends from the periphery of the month wheel 25 and is located between two successive teeth 70. Each slot 72, 73, 74 or 75 is associated with a month of the year and its depth is a function of the duration of that month. The slots 72 to 75 follow in circumferential manner in the same order as the months of the year to which they correspond.

The month wheel 25 has forty-eight successive angular positions, each stabilized through the stabilization of the pinion 26 by the jumper 31. One month is associated with each of these stabilized angular positions. When the month wheel 25 is pivoted by one step, it passes from one stabilized angular position to the following stabilized angular position, which corresponds to a passage of one month to the following month. The forty-eight teeth and the forty-eight slots of the month wheel 25 correspond to a cycle of four consecutive years, of which one is a leap year.

The slots 72 to 75 include:

- forty-eight slots of very shallow depth 72 each associated with a month of thirty-one days,
- sixteen slots of shallow depth 73 each associated with a month of thirty days,
- one slot of medium depth 74 associated with a month of February of twenty-nine days of a leap year, and
- three slots of great depth 75 each associated with a month of February of twenty-eight days of a non-leap year.

The feeler tail 44 is inserted successively in each of the slots 72 to 75, as the month wheel 25 is turned step by step. Each of the slots 73 to 75 has, over its entire length, the same uniform curvature as the feeler tail 44. Each of the slots 73 to 75 comprises an entry 77 situated at the periphery of the month wheel 25, between two consecutive peripheral teeth 70, as well as a widened section 78 which begins at a distance from these two peripheral teeth 70.

Each slot 72, 73, 74 or 75 comprises a bottom which forms a course beginning stop 76 for the feeler tail 44. In the absence of maneuvering of the actuation lever 9 by the finger 6, the elastic return exercised by the spring 12 is translated through a return of the lever 21 into a waiting position, in which the feeler tail 44 is pushed against one of the course beginning stops 76. Before being actuated, the lever 21 thus occupies a course beginning position determined by a course beginning stop 76 or, more precisely, by the depth at which this course beginning stop 76 is located. In summary, each time that it is actuated by the agency of its rack 20, the lever 21 carries out one angular course which always ends at the same place, but the beginning of which is variable as is its amplitude.

In FIGS. 3 to 9, the reference marks $R_1$ and $R_2$ are fixed markers added to facilitate the comprehension.

In FIG. 3, the month wheel 25 occupies the angular position associated with the month of September of a leap year. The day-of-the-month wheel 23 occupies the angular position associated with the day of the month 29. The corresponding date is 29 September of a leap year. Still in FIG. 3, no actuation has taken place and the lever 21 is in a waiting position, which will be its course beginning position for its next angular course.

In FIG. 4, the date passes from 29 to 30 September. Actuated via its rack 20, the lever 21 has just left its course beginning position of FIG. 3 and rocks as indicated by the arrows $B_1$, during one going course. This lever 21 then pulls along with it the double pawl 22, whose downstream pawl finder 51 rests passively, but whose upstream pawl finger 50, engaged with a tooth 61, makes the day-of-the-month wheel 23 turn by one step $P_1$ until it brings it into the position associated with the day of the month 30.

In FIG. 5, owing to the return exercised by the spring 12, the lever 21 carries out its return course $B_2$, consecutive to its going course $B_1$, and returns to its course beginning position. The upstream pawl finger 50 passes over a tooth 61 without hooking it, thanks to a rocking $B_3$ of the double pawl 22 against the return spring 49.

FIG. 6 illustrates the state of the perpetual calendar mechanism 2 following the return $B_2$ illustrated in FIG. 5. In this FIG. 6, the lever 21 has returned to the course beginning position which it occupied in FIG. 3. The day-of-the-month wheel 23 is in the angular position associated with the day of the month 30. The month wheel is in the same angular position as in FIG. 3. The corresponding date is 30 September of a leap year. It is the last day of September and it will be noted that the downstream pawl finger 51 is at the notch 63, the feeler tail 44 penetrating to the bottom of the slot 73 associated with the month of September of a leap year.

In FIG. 7, there takes place a first stage of a new change of date. The lever is driven in a rocking movement $B_4$, starting from its course beginning position of FIG. 6. Still in FIG. 7, the downstream pawl finger 51 is engaged with the tooth 64, in the notch 63, and makes the day-of-the-month wheel turn by one step $P_2$.

The rocking $B_4$ continues in FIG. 8, in which the downstream pawl finger 51 no longer acts upon the day-of-the-month wheel 23. In contrast, the upstream pawl finger 50 is hooked to a tooth 61 and makes the day-of-the-month wheel 23 pivot by a further step $P_3$. This day-of-the-month wheel 23 in turn actuates the month wheel by one step $P_4$, through the agency of its protruding tooth 62 which acts upon a tooth 70.

FIG. 9 illustrates the state of the perpetual calendar mechanism 2 once the rocking $B_4$ has been completed and the lever 21 has then been put back against the month wheel 25. In this FIG. 9, the day-of-the-month wheel 23 is in the position associated with the day of the month 1, whereas the month wheel 25 is in the position associated with the month of October of a leap year. Still in FIG. 9, it will be noted that the feeler tail 44 is situated in a slot of very shallow depth 72 corresponding to a month of October of thirty-one days.

When the day-of-the-month wheel 23 is initially in a position associated with a day of the month other than the last day of a month, a maneuver of the lever 21 leads to only the upstream pawl finger 50 acting upon this day-of-the-month wheel 23, which it makes turn by one step.

When the day-of-the-month wheel 23 is in a position associated with the last day of a month, a maneuver of the lever 21 also leads to a displacement of the day-of-the-month wheel 23. The number of steps this displacement includes depends upon the starting position of the lever 21 and thus the depth of the slot 72, 73, 74 or 75 in which the feeler tail 44 is initially located. The earlier the downstream pawl finger 51 is hooked in the notch 63 during a going movement of the lever 21 at the end of the last day of a month of thirty-one days, the more the day-of-the-month wheel 23 will be pivoted by a large number of steps.

When the month wheel 25 is in a position associated with a month, the slot 72, 73, 74 or 75 associated with this month is positioned on the path of the feeler tail 44 and the same applies to the course beginning stop 76 formed by the bottom of this slot.

When the month wheel 25 is in a position associated with a month of thirty-one days, the feeler tail 44 is driven into a slot of very shallow depth 72. In this case, a maneuver of the lever 21 at the end of the last day of the month leads to only the upstream pawl finger 50, at the exclusion of the downstream pawl finger 51, making the day-of-the-month wheel 23 be displaced, which turns by only one step.

When the month wheel 25 is in a position associated with a month of thirty days, the feeler tail 44 is driven into a slot of shallow depth 73. In this case, as described further above in relation to FIGS. 6 to 9, a maneuver of the lever 21 at the end of the last day of the month leads to the downstream pawl finger 51 making the day-of-the-month wheel 23 turn by one step, before the upstream pawl finger 50 also makes this day-of-the-month wheel 23 turn by one step.

When the month wheel 25 is in a position associated with a month of February of a leap year, that is to say with a month of twenty-nine days, the feeler tail 44 is driven into the slot of medium depth 74. In this case, a maneuver of the lever 21 at the end of the last day of the month leads to the downstream pawl finger 51 making the day-of-the-month wheel 23 turn by two steps, before the upstream pawl finger 50, in turn, makes this day-of-the-month wheel 23 turn by one step.

When the month wheel 25 is in a position associated with a month of February of a non-leap year, that is to say with a month of twenty-eight days, the feeler tail 44 is driven into one of three slots of great depth 74. In this case, a maneuver of the lever 21 at the end of the last day of the month leads to the downstream pawl finger 51 making the day-of-the-month wheel 23 turn by three steps, before the upstream pawl finger 50, in turn, makes this day-of-the-month wheel 23 turn by one step.

The invention is not limited to the embodiment described in the foregoing. In particular, the month wheel can comprise just twelve slots associated with twelve months of the year, and an annual calendar mechanism having such a month wheel can incorporate the invention.

The invention claimed is:

1. An annual or perpetual calendar mechanism, comprising:

a day-of-the-month mobile which is rotational between 31 successive angular positions each associated with one of 31 days of the month and which comprises a notch and a day-of-the-month wheel having 31 teeth, a month wheel which is rotational between successive angular positions each associated with one of the 12 months of the year, which has as many teeth as the month wheel has angular positions, and which defines course beginning stops each associated with a month and operational for controlling a course beginning position when the month wheel is in the angular position associated with the month, each of the teeth of the month wheel having a profile formed by a peripheral edge of the month wheel, wherein the peripheral edge of the month wheel also forms the course beginning stops which are bottoms of slots alternating with the teeth of the month wheel, an actuation finger for effecting, on one of the teeth of the month wheel, an actuation of one step making the month wheel pass from one month to the following month, at each passage of the day-of-the-month mobile from the last day of the month of one month to the first day of the month of the following month, a lever provided to be actuated once a day, starting from the course beginning position, a maneuvering device borne by the lever and comprising two pawl fingers, including a first pawl finger for effecting, on one of the 31 teeth of the day-of-the-month wheel, an actuation of one step making the day-of-the-month mobile pass from one day of the month to the following day of the month among the 31 successive positions, at each actuation of the lever, and a second pawl finger for effecting, on the notch, an actuation of the day-of-the-month mobile by a whole number of steps determined by the course beginning position of the lever, at the time of an actuation of the lever at the end of a month of fewer than 31 days.

2. The annual or perpetual calendar mechanism according to claim 1, wherein each of the 31 teeth of the day-of-the-month wheel has a profile formed by a peripheral edge of the day-of-the-month wheel, the peripheral edge of the day-of-the-month wheel also forming the notch which is positioned between two consecutive teeth among the 31 teeth of the day-of-the-month wheel.

3. The annual or perpetual calendar mechanism according to claim 2, wherein the day-of-the-month wheel, the month wheel, the lever, and the maneuvering device extend in a same plane.

4. The annual or perpetual calendar mechanism according to claim 2, wherein the 31 teeth of the day-of-the-month wheel are made up of 30 teeth of a first type and one tooth of a second type, each tooth of the first type having a first crest and a first rear face which extends progressively rearwards while going away from the first crest so as to be able to be hooked by the first pawl finger and not by the second pawl finger, the tooth of the second type having a second crest and a second rear face delimiting the notch, the second rear face extending progressively forwards while going away from the second crest such that the tooth of the second type can be hooked by the first pawl finger and by the second pawl finger.

5. The annual or perpetual calendar mechanism according to claim 1, wherein a piece defining at least one of the first and second pawl fingers is pivotably mounted on the lever by means of a cylindrical articulation comprising a cylindrical accommodation and a complementary cylindrical head, wherein the cylindrical accommodation is open radially at a radial passage between two positions angularly offset, one with respect to the other, about a rocking axis of the cylindrical head in the cylindrical accommodation, the cylindrical head being borne by a neck passing through the radial passage.

6. The annual or perpetual calendar mechanism according to claim 1, wherein a same piece pivotably mounted on the lever and resiliently biased against a stop of the lever defines both the first pawl finger and the second pawl finger, which second pawl finger is offset downstream with respect to the first pawl finger, considering a direction of pushing of a tooth of the day-of-the-month wheel by the first pawl finger.

7. The annual or perpetual calendar mechanism according to claim 1, wherein the lever comprises a feeler tail configured to be inserted in any slot among the slots and to be stopped by the bottom of the slot in the course beginning position.

8. The annual or perpetual calendar mechanism according to claim 7, wherein each of the slots associated with months of fewer than 31 days comprises an entry situated between two consecutive teeth of the month wheel and a section which is located at a distance from the two consecutive teeth and which is widened with respect to the entry.

9. The annual or perpetual calendar mechanism according to claim 7, wherein the feeler tail has a curvature which is uniform and which is centered on a rocking axis of the lever, at least the slots associated with months of fewer than 31 days each having, on their entire length, the same uniform curvature as the feeler tail.

10. The annual or perpetual calendar mechanism according to claim 1, further comprising:

a pinion which meshes with the teeth of the month wheel and which is associated with a display of the current month.

11. The annual or perpetual calendar mechanism according to claim 1, wherein the day-of-the-month wheel and the month wheel extend in a same plane, one of the teeth of the day-of-the-month wheel radially projecting further than the other teeth of the day-of-the-month wheel and forming the actuation finger.

12. A timepiece having an annual or perpetual calendar mechanism according to claim 1.

* * * * *